US009584905B2

(12) United States Patent
Christoph

(10) Patent No.: US 9,584,905 B2
(45) Date of Patent: Feb. 28, 2017

(54) AUDIO SIGNAL MIXING

(71) Applicant: Harman Becker Automotive Systems GmbH, Karlsbad (DE)

(72) Inventor: Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 19 days.

(21) Appl. No.: 14/293,865

(22) Filed: Jun. 2, 2014

(65) Prior Publication Data

US 2014/0363027 A1 Dec. 11, 2014

(30) Foreign Application Priority Data

Jun. 6, 2013 (EP) ..... 13170886

(51) Int. Cl.

| | |
|---|---|
| ***H04H 60/04*** | (2008.01) |
| ***H04R 3/00*** | (2006.01) |
| ***H04R 5/04*** | (2006.01) |
| ***H04S 1/00*** | (2006.01) |
| *H04S 3/00* | (2006.01) |

(52) U.S. Cl.

CPC ..... *H04R 3/00* (2013.01); *H04R 5/04* (2013.01); *H04S 1/00* (2013.01); *H04S 3/00* (2013.01)

(58) Field of Classification Search

CPC ..... H04S 3/02; H04S 2400/03; H04R 25/356
USPC ..... 381/119, 97, 104
See application file for complete search history.

(56) References Cited

U.S. PATENT DOCUMENTS

| | | | | |
|---|---|---|---|---|
| 2005/0195995 | A1* | 9/2005 | Baumgarte | H03G 5/165 381/104 |
| 2007/0098183 | A1* | 5/2007 | Enamito | H04S 3/002 381/71.1 |
| 2009/0210236 | A1 | 8/2009 | Moon et al. | |
| 2009/0214058 | A1 | 8/2009 | Christoph et al. | |
| 2012/0308018 | A1 | 12/2012 | Miao et al. | |

FOREIGN PATENT DOCUMENTS

WO 2006019719 A1 2/2006

OTHER PUBLICATIONS

Extended European Search Report for corresponding EP Application No. 13170886.9, mailed Aug. 23, 2013, 8 pages.
Crockett et al., "Next Generation Automotive Research and Technologies", AES 120th Convention, Paris, France, May 20-23, 2006, 13 pages.
Meier et al., "Spherical Surface Microphone Interpolation", Proceedings of ICSA, 2011, pp. 117-124.

* cited by examiner

*Primary Examiner* — George Monikang
(74) *Attorney, Agent, or Firm* — Brooks Kushman P.C.

(57) ABSTRACT

A system and a method for mixing at least two audio signals are provided that comprise transferring the audio signals with respective transfer functions, the audio signals each having an amplitude and a phase; adding the audio signals to provide an output signal representative of the mixed audio signals, the output signal having an amplitude and a phase; controlling at least one of the transfer functions of the signal lines so that the phase of the output signal is adapted to the phase of the audio signal with a higher signal strength than the other audio signal(s), the signal strengths corresponding to the amplitudes of the audio signals.

16 Claims, 5 Drawing Sheets

AUDIO SIGNAL MIXING

CROSS-REFERENCE TO RELATED APPLICATIONS

This application claims priority to EP Application No. 13 170 886.9 filed on Jun. 6, 2013, the disclosure of which is incorporated in its entirety by reference herein.

TECHNICAL FIELD

The disclosure relates to a system and method (generally referred to as a "system") for processing signals, in particular mixing signals.

BACKGROUND

When two or more signals, for example, audio signals, are mixed, the amplitude and phase constellation can be such that the signals are partly or even totally cancelled. For example, full cancellation occurs when two signals that are mixed have the same amplitude and opposite phases. It is normally not desired to experience any attenuation or cancellation when mixing signals. A common approach to overcome this backlog is to use only the magnitudes of the signals without any phase information. However, phase information may be important, for example, for achieving a sufficient audio localization. Audio mixing without any attenuation or phase effects is generally desired.

SUMMARY

A system for mixing at least two audio signals is provided that includes signal lines, an adder, and a line controller. The signal lines are configured to transfer the audio signals with respective transfer functions, each of the audio signals including an amplitude and a phase. The adder is coupled to the signal lines and is configured to add the audio signals to provide an output signal representative of the mixed audio signals. The output signal includes an amplitude and a phase. The line controller is configured to control at least one of the transfer functions of the signal lines so that the phase of the output signal is adapted to the phase of the audio signal with a higher signal strength than the other audio signal(s) in which the signal strengths correspond to the amplitudes of the audio signals.

Furthermore, a method for mixing at least two audio signals is provided. The method includes transferring the audio signals with respective transfer functions in which the audio signals each include an amplitude and a phase. The method further includes adding the audio signals to provide an output signal representative of the mixed audio signals in which the output signal includes an amplitude and a phase. The method further includes controlling at least one of the transfer functions of the signal lines so that the phase of the output signal is adapted to the phase of the audio signal with a higher signal strength than the other audio signal(s) in which the signal strengths correspond to the amplitudes of the audio signals.

Other systems, methods, features and advantages will be, or will become, apparent to one with skill in the art upon examination of the following detailed description and figures. It is intended that all such additional systems, methods, features and advantages be included within this description, be within the scope of the invention and be protected by the following claims.

BRIEF DESCRIPTION OF THE DRAWINGS

The system may be better understood with reference to the following description and drawings. The components in the figures are not necessarily to scale, emphasis instead being placed upon illustrating the principles of the invention. Moreover, in the figures, like referenced numerals designate corresponding parts throughout the different views.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
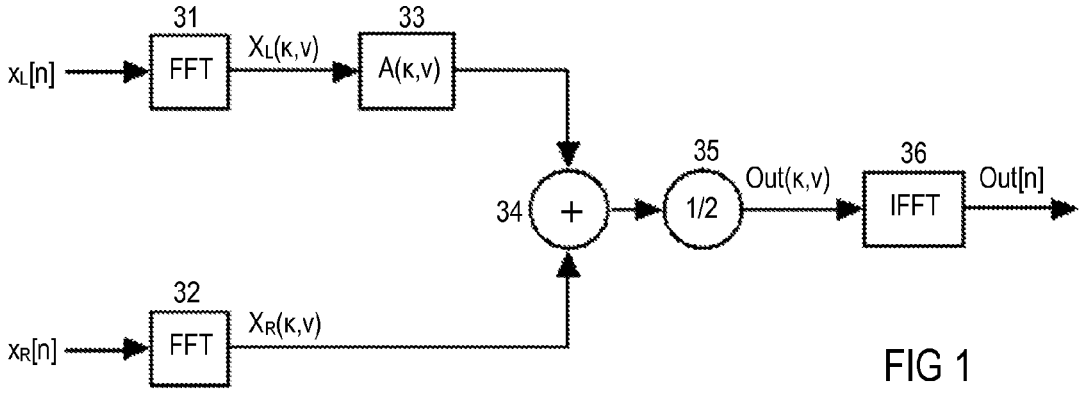
FIG. 1 is a block diagram illustrating the structure of a general audio signal mixing system.

Referring to FIG. 1, two signals, (e.g., two digital audio signals xL[n] and xR[n]), may be mixed (e.g., added in the spectral domain) by transforming the two audio signals xL[n] and xR[n] from the time domain into the spectral domain to provide spectral domain audio signals $XL(\kappa,\nu)$ and $XR(\kappa,\nu)$. One of the spectral domain audio signals $XL(\kappa,\nu)$ and $XR(\kappa,\nu)$, (e.g., audio signal $XL(\kappa,\nu)$), is filtered with a transfer function $A(\kappa,\nu)$, and the filtered audio signal $XL(\kappa,\nu)$ is added with the non-filtered audio signal $XR(\kappa,\nu)$; the sum of both is divided by two to provide an output signal $OUT(\kappa,\nu)$ in the spectral domain. Output signal $OUT(\kappa,\nu)$ is then transformed from the spectral domain back to the time domain to provide an output signal Out[n] in the time domain. The transformations of the audio signals xL[n] and xR[n] from the time domain into the spectral domain are performed by two fast Fourier transformation blocks 31 and 32, while the filtering of the audio signal $XL(\kappa,\nu)$ is performed by filter block 33. Adder block 34 adds the filtered audio signal XL(κ,ν) with the non-filtered audio signal XR(κ,ν), whose output signal is divided by two in divider block 35 and then re-transformed into the time domain by an inverse fast Fourier transformation block 36.

Filter block 33 may be a time-variant filter in the spectral domain having the following transfer function A(κ,ν):

$$A(\kappa, \nu) = \frac{X_R(\kappa, \nu) \cdot |X_L(\kappa, \nu)|}{X_L(\kappa, \nu) \cdot |X_R(\kappa, \nu)|}. \quad (1)$$

An efficient way to calculate the output signal OUT(κ,ν) can be expressed as follows:

$$\mathrm{OUT}(\kappa, \nu) = \frac{1}{2} \cdot \left( \frac{|X_L(\kappa, \nu)| \cdot X_R(\kappa, \nu)}{|X_R(\kappa, \nu)|} + X_R(\kappa, \nu) \right). \quad (2)$$

The calculation may be done using short-time Fourier transformation with overlap-add (OLA). With audio signals having a sample rate of Fs=44.1 kHz, use may be made of a Hamming window for the input signals and the output audio signal (which is the mixed input signals) and of a fast Fourier transformation (FFT) having a length of N=512 taps with a feed rate of R=N/8, which is 64 samples, which results in an overlap of 87.5%.

Figure 2:
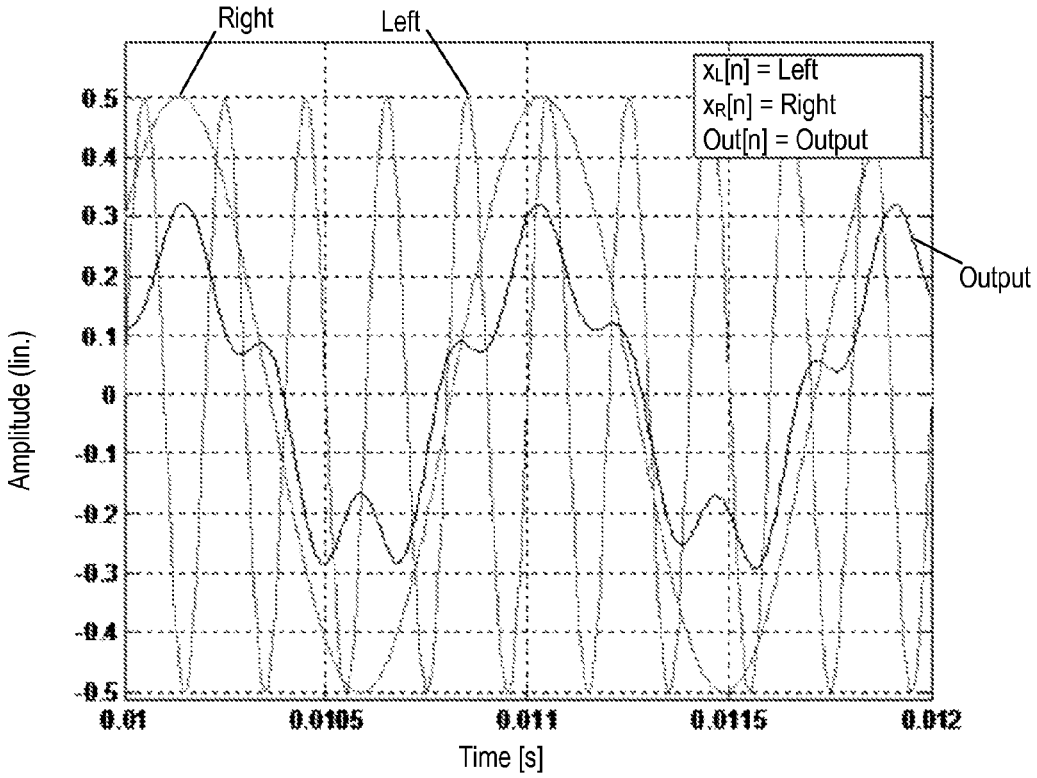
FIG. 2 is a diagram illustrating the time domain input and output signals of the system of FIG. 1.

It has been found that when mixing signals according to the method described above in connection with FIG. 1, artifacts may occur that deteriorate the output audio signal. Most of the artifacts are inconvenient to a listener. In the diagram in FIG. 2, the graphs of two exemplary sinusoidal signals of different frequencies, which form input signals xL[n] and xR[n], and of the output signal Out[n] obtained therefrom by mixing the input signals xL[n] and xR[n] are shown. In the following examples, line controller and line control include all analog and digital hardware, software and other measures and steps that control, affect and perform variations in the transfer function, including any delay times in at least one of the signal lines that transfer the audio signals. Although the examples are based on two audio signals, mixing of more than two audio signals can be similarly performed.

Figure 3:
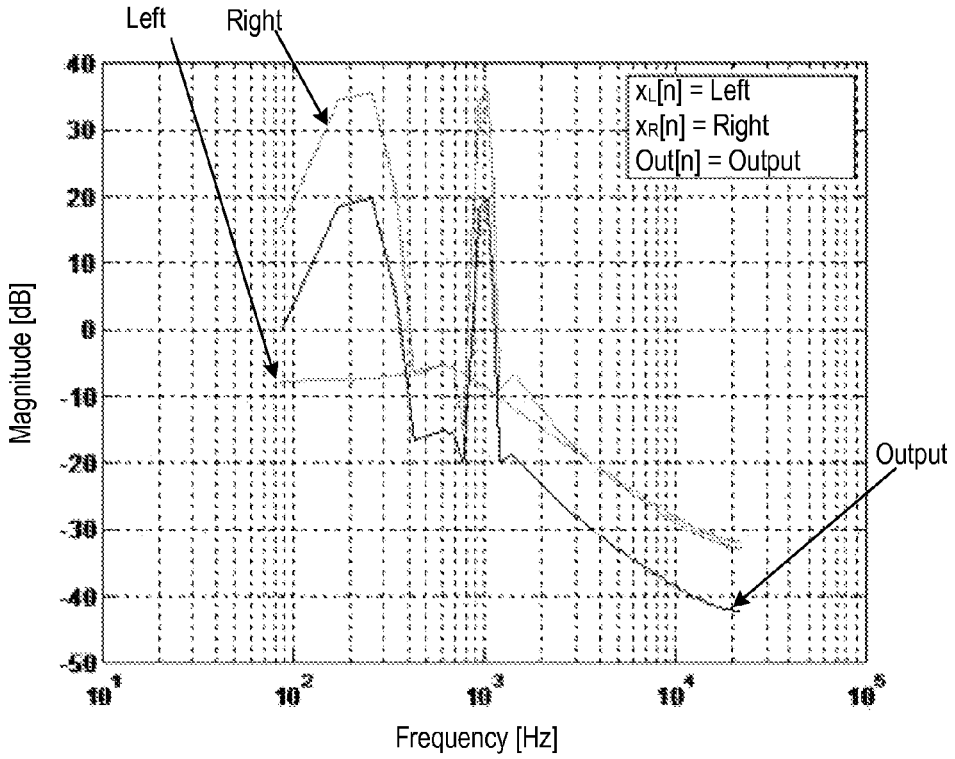
FIG. 3 is a diagram illustrating the power spectral density of the input and output signals of the system of FIG. 1.
Figure 4:
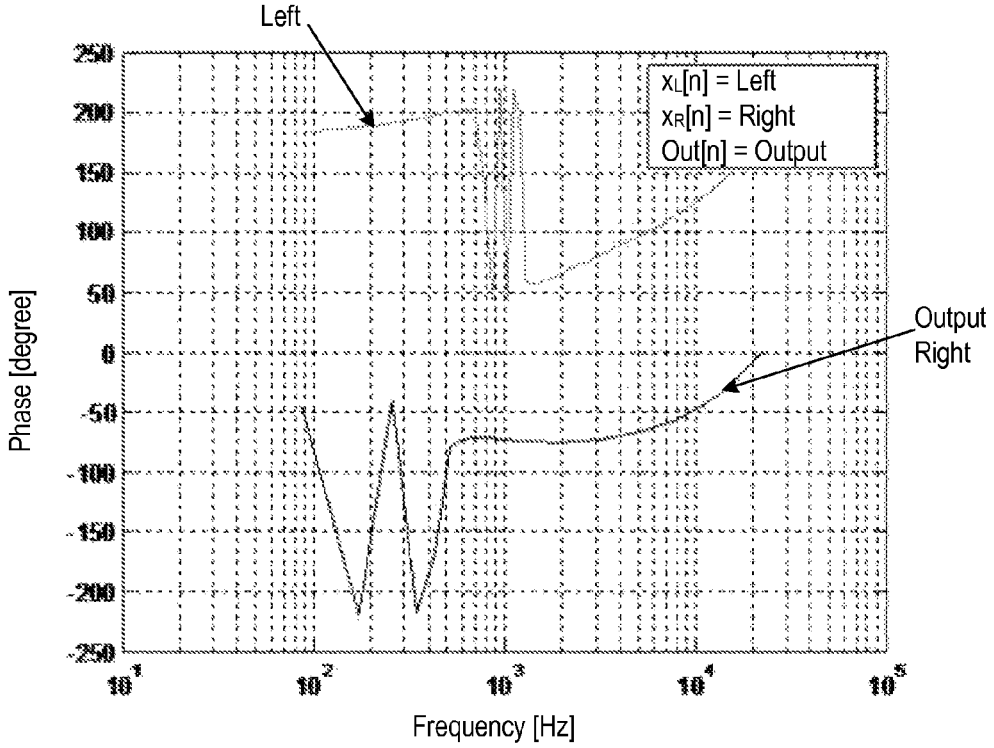
FIG. 4 is a diagram illustrating the phase frequency responses of the input and output signals of the system of FIG. 1.

When comparing the power spectral densities (PSD) of input signals xL[n] and xR[n] and output signal Out[n], as depicted in the diagram of FIG. 3, it can be seen that the output signal does not have a level that is 6 dB below one of the input signals' levels, as one would expect from equation 2. The reason for this is that the Hamming window requires an amplitude correction of about 21/3 (R/N). If the effect of the Hamming window on the amplitude is rectified, the curves meet these expectations. The output signal also has, as expected, the same phase characteristic as one of the input signals, in the present case input signal xR[n], as can be seen from FIG. 4. However, output signal Out[n], (i.e., the mixed input signals xL[n] and xR[n]), still includes some audible artifacts and the time signal is not like the signal that would result from proper mixing.

In the above example, the phase characteristic of output signal Out[n] is used completely, (i.e., over its full spectral range of the "right" input audio signal xR[n]), although a sufficient magnitude level of the input audio signal xR[n] is only present at frequency f=200 Hz. At frequency f=1 kHz, at which the "left" input audio signal xL[n] has its maximum, signal xR[n] has a level that is virtually zero, (i.e., as low as the noise level). The same applies to the frequency characteristic at this frequency. Output signal Out[n] thus includes the correct levels and the correct phase characteristic of signal xR[n] at frequency f=200 Hz, but an arbitrary, for example, noisy, phase characteristic at frequency f=1 kHz. This turned out to be the reason for the generation of acoustic artifacts.

To overcome this drawback, the phase characteristic of the desired signal, (i.e., one of the two input signals), may only control output signal Out[n] if it has a certain strength, for example, amplitude, magnitude level, power, average magnitude, loudness, etc. Moreover, even in case the desired signal does not have sufficient strength, the desired signal may control output signal Out[n] if its strength has a certain level exceeding a given threshold above the other input signal's strength. In the frequency ranges in which these requirements are not met, output signal Out[n] is controlled by the other input signal. As a result, output signal Out[n] has virtually no artifacts.

Figure 5:
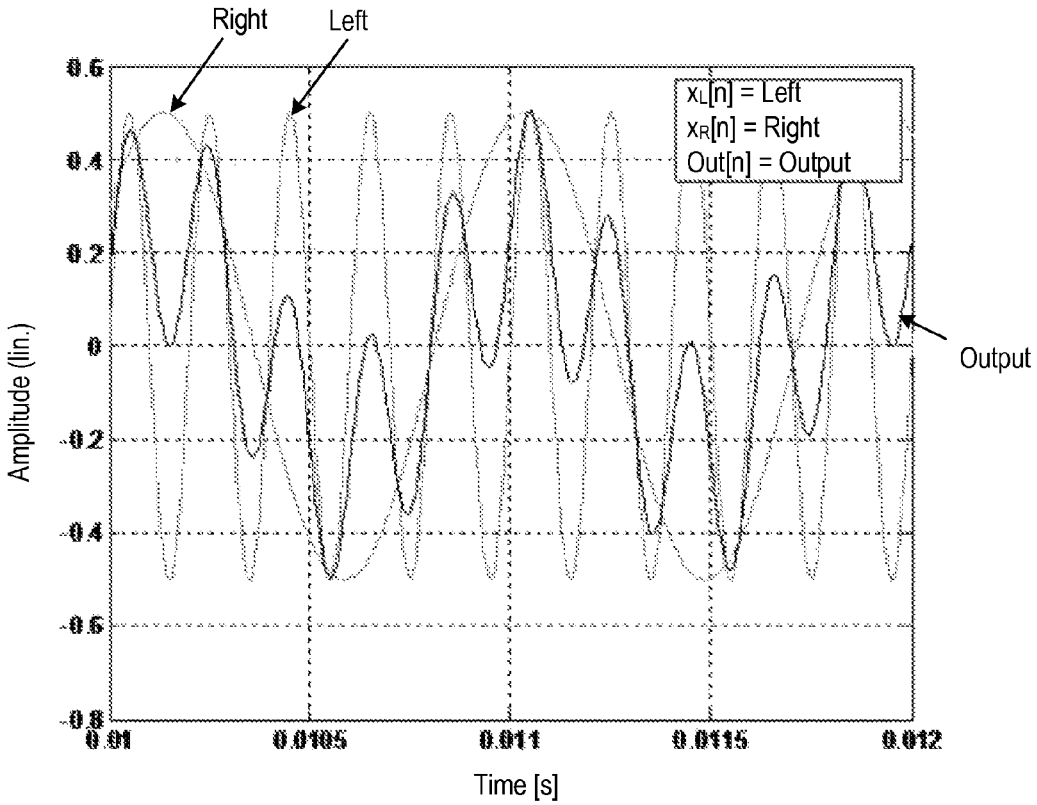
FIG. 5 is a diagram illustrating the time domain input and output signals of the system of FIG. 1 with additional phase adaption.

Referring to FIG. 5, the phase of the desired signal "imprints" output signal Out[n] as long as the amplitude of the respective spectral line (bin) is greater than the amplitude of the other input signal at the same frequency and the given threshold. Provided a threshold of TH=−1 dB, a resulting exemplary graph of output signal Out[n] may be as shown in FIG. 5. As can be seen, the resulting output signal Out[n] in the time domain is as desired. No disturbing acoustic artifacts are perceptible. In FIG. 5, the desired signals (e.g., input signals xL[n] and xR[n]) are also depicted as amplitude time graphs.

Figure 6:
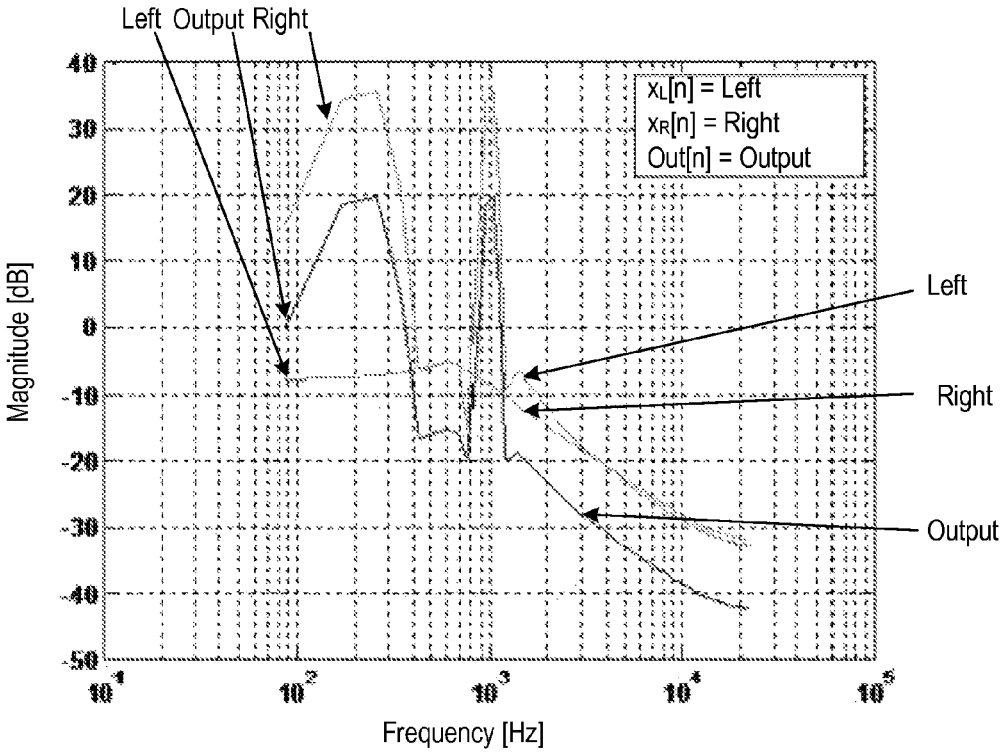
FIG. 6 is a diagram illustrating the power spectral density of the input and output signals of the system of FIG. 1 with additional phase adaption.
Figure 7:
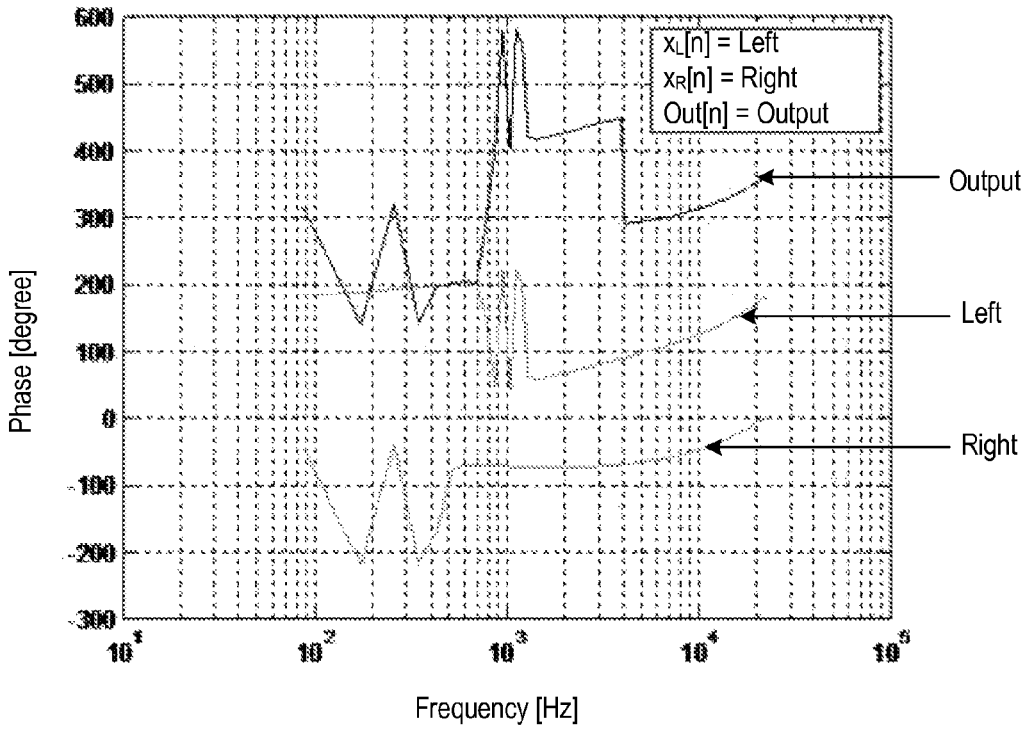
FIG. 7 is a diagram illustrating the phase frequency responses of the input and output signals of the system of FIG. 1 with additional phase adaption.

FIG. 6 illustrates the power spectral density of output signal Out[n] and input signals xL[n] and xR[n] corresponding to the amplitude time graphs of FIG. 5. As can be seen, the power spectral density of output signal Out[n] is also as desired. The corresponding phase characteristics of output signal Out[n] and input signals xL[n] and xR[n] are depicted in FIG. 7 as phase frequency graphs. The phase characteristic of output signal Out[n] is modified and corresponds for frequencies below frequency f=800 Hz to the phase characteristic of input signal xR[n] due to its distinctly higher amplitude level in this spectral range over input signal xL[n]. Above frequency f=800 Hz, the phase of output signal Out[n] corresponds to the phase of input signal xL[n] because of its amplitude level distinctly exceeding the amplitude level of input signal xR[n] in this spectral range. The diagrams shown in FIGS. 6 and 7 illustrate that the magnitude characteristic and the power spectral density of output signal Out[n] are maintained, while its phase characteristic is adapted to the phase characteristic of the "dominating" input signal xL[n] or xR[n] in particular frequency ranges. This way of mixing two input signals practically provides a much more pleasant aural impression since in each spectral range the input signal that contributes most to output signal Out[n] determines the phase characteristic of output signal Out[n] and thus the correct aural impression.

However, certain structures of input signals xL[n] and xR[n] may cause artifacts when processed in the manner outlined above. It has been found that strongly correlating input signals that differ from each other, for example, only by a constant delay time, exhibit the most annoying artifacts. Small delay times, for example, a few samples, are negligible, while longer delay times have an audible impact on output signal Out[n], in particular when the delay time is longer than the length of the analyzing window of the fast Fourier transformation (FFT), so that detection of a correlation between the two input signals xL[n] and xR[n] is no longer possible. Accordingly, a certain compensation for the delay time between the two input signals xL[n] and xR[n]

may be provided to allow for correlation detection. Initially, it is detected whether there is any correlation between the two input signals xL[n] and xR[n], and if so, how much delay time there is. The degree of correlation may be determined by way of cross correlation operations on the two input signals xL[n] and xR[n]. The cross correlation operations may be performed blockwise in the time or spectral domain. Alternatively, cross correlation may be implemented in the time domain as a time-continuous, recursive operation or by way of an adaptive filter such as an adaptive finite impulse response (FIR) filter that models a time-continuous cross correlator.

Figure 8:
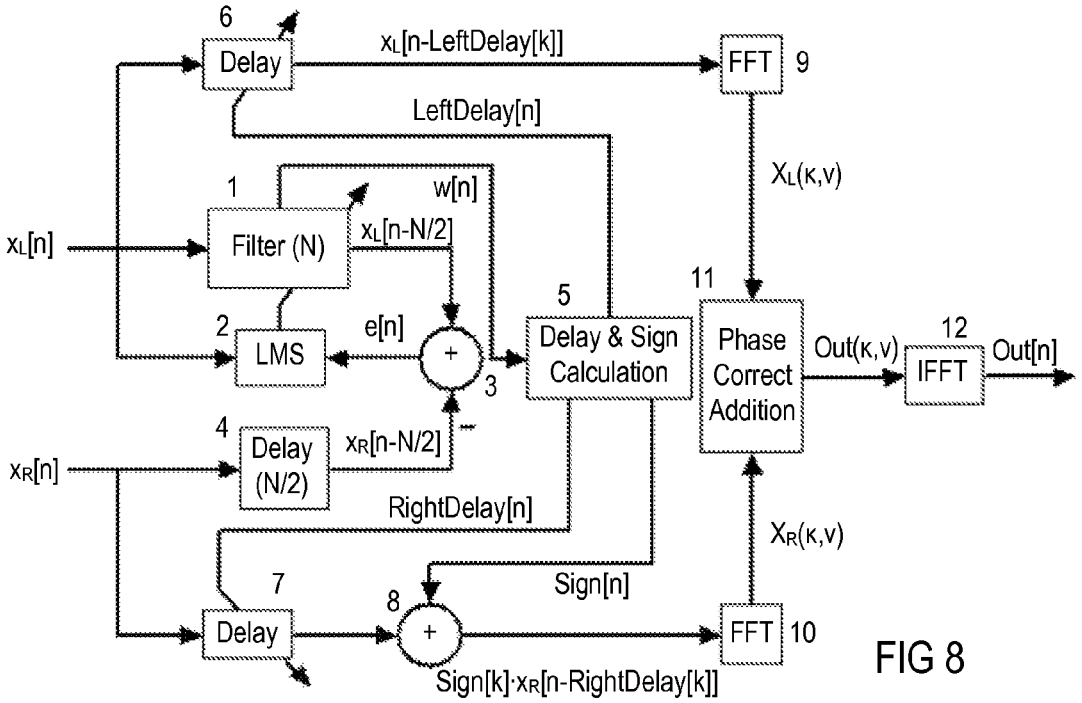
FIG. 8 is a block diagram illustrating the structure of an audio signal mixing system with phase adaption.

Referring to FIG. 8, an audio signal mixing system with a time-continuous cross correlator arrangement may employ an adaptive finite impulse response (FIR) filter 1, which is supplied with one of the input signals xL[n] and xR[n], in the present case, for example, input signal xL[n], and which is controlled by a controller 2 that uses the least mean square (LMS) algorithm for calculating a control signal for controlling adaptive filter 1 from an error signal e[n] and the input signal xL[n]. Adaptive filter 1 has a length of N. Error signal e[n] is calculated from the output signal of adaptive filter 1 and the delayed input signal xR[n-N/2] by subtracting the delayed input signal xR[n-N/2] from the output signal of adaptive filter 1, for example, by way of subtractor 3. The other input signal xR[n] is delayed by N/2, for example, by way of delay element 4. The filter coefficients wi[n] of adaptive filter 1, in which i=1 . . . N, are copied into delay and sign calculation block 5 that generates a left delay control signal LeftDelay[n], a right delay control signal RightDelay[n] and a sign control signal Sign[n] therefrom. The left delay control signal LeftDelay[n] is used to control a controllable delay element 6 that is supplied with input signal xL[n] and that provides the delayed input signal xL[n-LeftDelay[k]], which is input signal xL[n] delayed by a left delay time LeftDelay[k]. Accordingly, the right delay control signal RightDelay[n] is used to control a controllable delay element 7 that is supplied with input signal xR[n] and that provides the delayed input signal xR[n-RightDelay[k]], which is the input signal xR[n] delayed by a right left delay time RightDelay[k]. The right delay control signal RightDelay[n] is multiplied, for example, by way of multiplier 8, with the sign control signal Sign[n] to provide a compensated delayed input signal Sign[n]·xR[n-RightDelay[k]]. The delayed input signal xL[n-LeftDelay[k]] is supplied to FFT block 9, which provides a spectral domain signal xL(κ,ν), and the compensated delayed input signal Sign[n]·xR[n-RightDelay[k]] is supplied to FFT block 10, which provides a spectral domain signal xR(κ,ν), in which κ signifies a frequency bin and ν signifies the time. Signals xL(κ,ν) and xR(κ,ν) from FFT blocks 9 and 10 are supplied to phase correction block 11, which generates the spectral domain output signal Out(κ,ν), which is transformed back into a time domain signal Out[n] through an inverse fast Fourier transformation (IFFT) block 12.

The cross correlator arrangement used in the system of FIG. 8 is intended to provide information on whether the two input signals xL[n] and xR[n] are correlated or not. In such arrangement, the filter coefficients wi[n] of adaptive filter 1, in which i=1 . . . N, may be copied into delay and sign calculation block 5 on a regular basis, for example, every 0.25 s, where they are analyzed in order to identify its maximum absolute magnitude as well as the sign of the maximum. The position within the set of filter coefficients wi[n] that carries the maximum magnitude values may be copied into a buffer memory having a length L and be stored there as buffered values Bi[n], in which i=1, . . . , L, and the oldest of values Bi[n] in the buffer may be overwritten with the current maximum magnitude value. Then, all values of maximum magnitudes contained in the buffer memory may be analyzed in terms of magnitude. If the fluctuations of the magnitude values are below a certain threshold, input signals xL[n] and xR[n] may be considered as correlating. Otherwise, even if only one of the values is above the threshold, input signals xL[n] and xR[n] may be considered as not correlating.

When input signals xL[n] and xR[n] are found to be correlating, there is still information needed regarding the phase relationship between the two signals, in particular which one of the two input signals xL[n] and xR[n] is preemptive. For finding out what the phase relationship is, one approach may be to again employ the algorithm outlined above, whereby input signal xL[n] is taken as the reference signal for the adaptive filter one time and the input signal xR[n] is taken the other time. When both input signals xL[n] and xR[n] correlate, adaptive filter 1 is causal only in one of the two algorithm runs. This particular run is the one that provides the information needed.

Another approach is to use adaptive filter 1 with a length that is at least redoubled compared to the filter length in the case described above. However, when using, for example, a redoubled filter length 2N, the delay time of the input signal that is taken as the desired signal has to be delayed by half the length of adaptive filter 1, which is then N instead of N/2. The decision to delay one of the two input signals xL[n] and xR[n] can be easily made by analyzing whether the maximum magnitude is in the first or second half of the coefficient set.

Again, when the two input signals xL[n] and xR[n] correlate, the median value of values Bi[n] stored in the buffer memory is calculated, from which one half of the filter length is then subtracted. If the result of the subtraction is positive, the desired signal, which is input signal xL[n] in the example of FIG. 8, is delayed by a time that has been calculated from the signal that serves as the reference signal of the adaptive filter. If the result of the subtraction is negative, the other input signal xR[n] is delayed by the magnitude of the time that has been calculated from the signal that serves as the reference signal of the adaptive filter. In each case, the respective other input signal xR[n] or xL[n] is not delayed.

Further, when the two input signals xL[n] and xR[n] correlate, the impulse response wi[n] of the adaptive filter contains, in addition to information on their relative delays, information on the phase relationship of the two input signals xL[n] and xR[n]. For ex-ample, when the maximum of the (estimated) impulse response is positive, both input signals xL[n] and xR[n] have the same phase. Otherwise, both have opposite phases, which can be compensated through adequate processing, e.g., inverting the phase of one of the input signals xL[n] or xR[n].

As the adaptive filter has a finite length, for example, 2N=128 samples (although longer delay times may occur under certain circumstances), a safety margin may be included so that the filter length may be set to, for example, 256 samples or more. On the other hand, as basically only the long-term correlation has significant relevance, the adaptive filter may not be updated with each sample in order to save computation time. Instead, updates may be made on an R-sample basis, in which R may be, for example, 64 samples or more.

Figure 9:
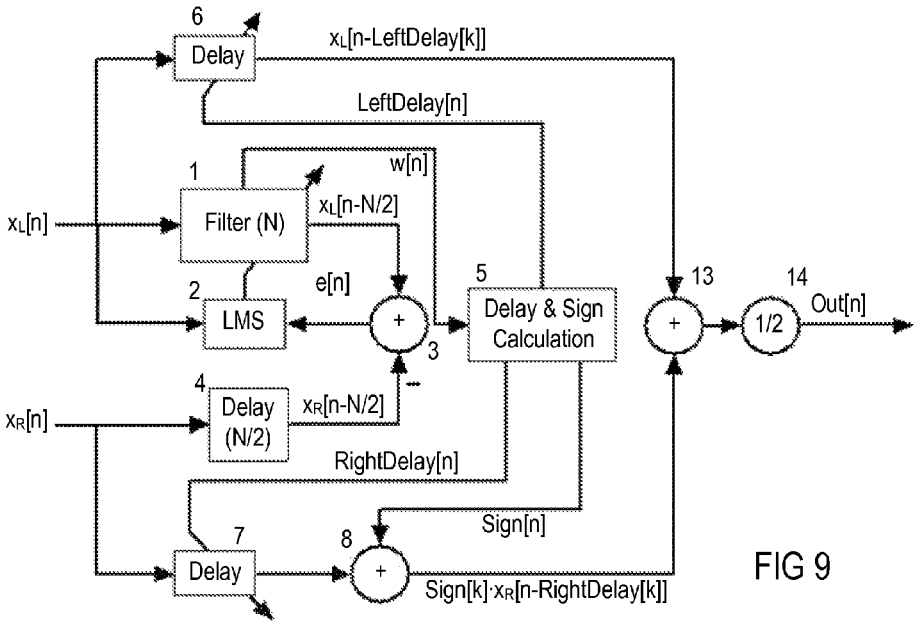
FIG. 9 is a block diagram illustrating the structure of a simplified audio signal mixing system operating in a broadband manner solely in the time domain.

Furthermore, the computational effort can be additionally or alternatively reduced in some applications by giving up all signal processing in the spectral domain and doing all signal processing exclusively in the time domain. An accordingly adapted arrangement based on the arrangement shown in FIG. 8 is illustrated in FIG. 9. In the arrangement of FIG. 9, the delayed input signal xL[n-LeftDelay[k]] and the compensated delayed input signal Sign[n]·xR[n-RightDelay[k]] are not supplied to FFT blocks such as FFT blocks 9 and 10 in the arrangement of FIG. 8, but are supplied to adder 13, after which they are summed up, then divided by two, for example, by means of divider 14, to provide output signal Out[n].

When the input signal that serves as the desired signal has an amplitude that is small or even virtually zero, the adaptation process in the adaptive filter slows down or even stops. This means that the filter coefficients can no longer be updated and the position of the maximum thus freezes. If this condition occurs for a sufficient amount of time, a positive correlation decision is definitely made including related calculations of the corresponding delay times LeftDelay[n] and RightDelay[n] and input sign Sign[n]. However, the decision made and the related calculations are incorrect. To overcome this drawback, a noise signal with a small amplitude (e.g., −80 dB) may be added to the desired signal or decisions and calculation results may be ignored as long as the desired signal is below a certain threshold (e.g., −80 dB). In the first option, when fading out one or both of two correlating input signals, the algorithm will always make a decision that the signals are uncorrelated, so when one or both input signals are faded in, calculations would start again from the beginning. In the second option, the decision made and the related calculations will be maintained if the desired signal is above the threshold while fading in. Otherwise calculations will start again.

Figure 10:
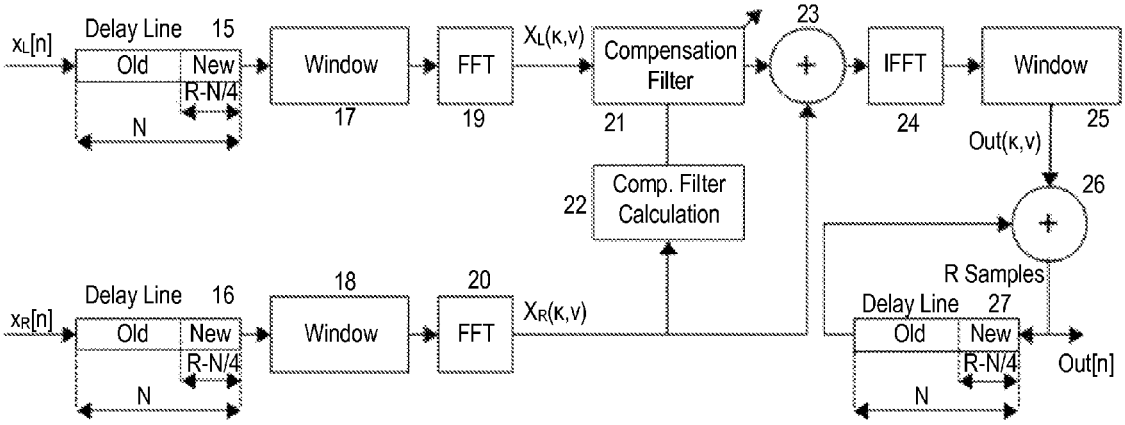
FIG. 10 is a block diagram illustrating an alternative structure of an audio signal mixing system with phase adaption.

Another exemplary audio signal mixing system is depicted in FIG. 10. This system and the method implemented in this system are based on the power corrected interpolation (PCI) algorithm, according to which the signal power of output signal Out(κ,ν) is equal to the sum of the powers of the two input signals XL(κ,ν) and XR(κ,ν), which can be expressed as:

$$|\mathrm{OUT}(\kappa,\nu)|^2=|X_L(\kappa,\nu)|^2+|X_R(\kappa,\nu)|^2, \tag{3}$$

which applies in the spectral domain to each frequency bin κ at all times ν. The PCI algorithm is adapted to be applicable to the phase-corrected mixing of two complex signals.

The system of FIG. 10 includes two delay lines 15 and 16 supplied with time domain input signals xL[n] and xR[n], two windowing blocks 17 and 18 connected downstream of delay lines 15 and 16 and two FFT blocks 19 and 20 connected downstream of windowing blocks 17 and 18. FFT blocks 19 and 20 provide the spectral domain input signals XL(κ,ν) and XR(κ,ν), one of which, for example, XL(κ,ν), is supplied to compensation filter block 21 having a transfer characteristic T(κ,ν), and the other, e.g., XR(κ,ν), is supplied to compensation filter calculation block 22 and adder 23, which is also supplied with the output signal of compensation filter block 21. Compensation filter calculation block 22 accordingly calculates and controls the current transfer function T(κ,ν) of compensation filter block 21 dependent on the spectral domain input signal XR(κ,ν). The output signal of adder 23 is transformed by IFFT block 24 and a subsequent windowing block 25 into output signal Out(κ,ν), which is supplied to adder 26. Adder 26 further receives the output signal of delay line 27, which is fed with the output signal of adder 26, which is the system output signal Out[n]. The windowing technique used in windowing blocks 17, 18 and 25 may be, for example, a Hanning window or any other appropriate window such as Bartlett, Gauss, Hamming, Tukey, Blackman, Blackmann-Harris, Blackmann-Nuttal, etc. Delay lines 15, 16 and 20 have a length of N and are split into an old part and a new part, in which the new part has, for example, a length of R=N/4. For example, delay lines 15, 16 and 20 may comprise N delay elements.

The calculation of the transfer function T(κ,ν) can be mathematically described as follows:

$$p(\kappa,\nu)=\frac{|X_L(\kappa,\nu)+X_R(\kappa,\nu)|^2-(|X_L(\kappa,\nu)|^2+|X_R(\kappa,\nu)|^2)}{2\cdot(|X_L(\kappa,\nu)|^2+|X_R(\kappa,\nu)|^2)}, \tag{4}$$

in which p(κ,ν) is an auxiliary item. The transfer function T(κ,ν) can then be calculated from p(κ,ν) according to:

$$T(\kappa,\nu)=\sqrt{p(\kappa,\nu)^2+1}-p(\kappa,\nu), \tag{5}$$

so that output signal Out(κ,ν) can be expressed as:

$$\mathrm{OUT}(\kappa,\nu)=T(\kappa,\nu)\cdot X_L(\kappa,\nu)+X_R(\kappa,\nu). \tag{6}$$

By way of the PCI algorithm, the spectral domain input audio signals XL(κ,ν) and XR(κ,ν) can be mixed without any further preprocessing and without unwanted comb filtering effects. An extreme value analysis proves that the time domain output signal Out[n] exactly follows the left input audio signal xL[n] or the right input audio signal xR[n] if the respective other signal is virtually zero, which is:

$$\mathrm{Out}[n]=\begin{cases} x_L[n], \text{ if } x_R[n]=0 \\ x_R[n], \text{ if } x_L[n]=0 \end{cases}. \tag{7}$$

If both input audio signals xL[n] and xR[n] are greater than zero, output signal Out[n] follows the input signal with the higher amplitude and adapts to the phase of this input signal. If both input audio signals xL[n] and xR[n] are equal in amplitude and phase, i.e., output signal Out[n] is:

$$\mathrm{Out}[n]=2\cdot x[n]. \tag{8}$$

If both input audio signals xL[n] and xR[n] are equal in amplitude, but opposite in phase, i.e., output signal Out[n] is:

$$\mathrm{Out}[n]=\left(\sqrt{\left(\frac{1}{2}\right)^2+1}-\frac{1}{2}\right)\cdot x_L[n]. \tag{9}$$

As can be seen from equation 9, there is no decrease of output signal Out[n] as with a common complex addition to zero, but it still offers a certain reduced amplitude, whereby the phase of the reference input signal, i.e., the input signal that is weighted with the transfer function T(κ,ν), is selected as the general phase.

Introducing scaling factor D to the auxiliary item p(κ,ν) of equation 4, the magnitude of output signal Out[n] can be additionally controlled so that output signal Out[n] as of creation 9 can read as:

$$\mathrm{Out}[n]=\left(\sqrt{\left(\frac{D}{2}\right)^2+1}-\frac{1}{2}\right)\cdot x_L[n]. \tag{10}$$

In most cases, D is chosen to be 1. If D is greater than 1, the sum signal becomes greater; if D is equal to 0, it is the commonly used mixing in the spectral domain (mono mix), which can be expressed as:

$$\mathrm{Out}[n]=\tfrac{1}{2}\cdot(x_L[n]+x_R[n]). \tag{11}$$

While various embodiments of the invention have been described, it will be apparent to those of ordinary skill in the art that many more embodiments and implementations are possible within the scope of the invention. Accordingly, the invention is not to be restricted except in light of the attached claims and their equivalents.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system for mixing audio signals comprising: signal lines configured to transfer the audio signals with respective transfer functions, the audio signals each having an amplitude and a phase; an adder coupled to the signal lines and configured to add the audio signals to provide an output signal representative of the mixed audio signals, the output signal having an amplitude and a phase; and a line controller configured to control at least one of the respective transfer functions of the signal lines so that the phase of the output signal is adapted to the phase of the audio signal with a higher signal strength than at least one of other audio signals, the signal strengths corresponding to the amplitudes of the audio signals, where the line controller is configured to control at least one of the transfer functions of the signal lines so that a signal power of the output signal is equal to a sum of the powers of the audio signals, and where the line controller comprises a compensation filter arranged in one of the signal lines and a compensation filter controller coupled to the compensation filter and to at least one of other signal line, the compensation filter being configured to provide a compensation transfer function for the one signal line that is controllable by the compensation filter controller, and the compensation filter controller being configured to control the compensation filter based on the at least one of other audio signals so that the signal power of the output signal is equal to the sum of the powers of the audio signals.

2. The system of claim 1, where at least one of the transfer functions of the signal lines comprises a delay time, and where the line controller is configured to evaluate the signal strengths of the audio signals and to control the delay time so that the phase of the output signal corresponds to the phase of the audio signal whose signal strength is higher than a threshold strength.

3. The system of claim 2, where at least one of the signal lines comprises at least one controllable delay element, and where the delay time is controlled through the at least one controllable delay element.

4. The system of claim 3, where the line controller comprises an adaptive filter supplied with the audio signals that has a transfer function and where the line controller comprises a delay and sign calculator coupled to the adaptive filter, the adaptive filter being configured to filter one of the audio signals according to a reference signal representing the at least one of other audio signal, and the delay and sign calculator being configured to control the at least one controllable delay element based on the transfer function of the adaptive filter.

5. The system of claim 1, where at least one of the transfer functions of the signal lines comprises a delay time, and where the line controller is configured to evaluate the signal strengths of the audio signals and to control the delay time so that the phase of the output signal corresponds to the phase of the audio signal whose signal strength is higher than the signal strength(s) of each of the at least one other audio signals.

6. The system of claim 1, further comprising a Fourier transformation processor coupled to and arranged upstream of the adder and an inverse Fourier transformation processor coupled to and arranged downstream of the adder, the adder being configured to operate in a spectral domain.

7. A method for mixing audio signals comprising: transferring the audio signals with respective transfer functions, the audio signals each having an amplitude and a phase; adding the audio signals to provide an output signal representative of the mixed audio signals, the output signal having an amplitude and a phase; controlling at least one of the respective transfer functions of signal lines so that the phase of the output signal is adapted to the phase of the audio signal with a higher signal strength than at least one of other audio signals, the signal strengths corresponding to the amplitudes of the audio signals, and controlling of at least one of the transfer functions of the signal lines so that a signal power of the output signal is equal to a sum of the powers of the audio signals, where controlling the at least one of the transfer functions of the signal lines comprises compensation filtering of one of the audio signals based on the at least one of other audio signals to provide a compensation transfer function for the at least one transfer function that is controllable so that the signal power of the output signal is equal to the sum of the powers of the audio signals.

8. The method of claim 7, where at least one of the transfer functions of the signal lines comprises a delay time, the method further comprising evaluating the signal strengths of the audio signals and controlling the delay time so that the phase of the output signal corresponds to the phase of the audio signal whose signal strength is higher than a threshold strength.

9. The method of claim 7, where at least one of the transfer functions of the signal lines comprises a delay time, the method further comprising evaluating the signal strengths of the audio signals and controlling the delay time so that the phase of the output signal corresponds to the phase of the audio signal whose signal strength is higher than the signal strength of each of the at least one of other audio signals.

10. The method of claim 8, where evaluating the signal strengths comprises adaptive filtering of the audio signals with a transfer function; calculating the delay and sign in accordance with the adaptive filtering, the adaptive filtering comprising filtering of one of the audio signals according to a reference signal representing the at least one of other audio signals; and delay and sign calculating comprising controlling of at least one controllable delay element based on the transfer function of the adaptive filtering.

11. The method of claim 7, further comprising Fourier transformation processing before adding and inverse Fourier transformation processing upon adding, adding being performed in a spectral domain.

12. A system for mixing audio signals comprising: an adder coupled to signal lines that are configured to transfer the audio signals with respective transfer functions and each of the audio signals having an amplitude and a phase, wherein the adder is configured to add the audio signals to provide an output signal representative of the mixed audio signals, the output signal having an amplitude and a phase; and a line controller configured to control at least one of the respective transfer functions of the signal lines so that the phase of the output signal is adapted to the phase of the audio signal with a higher signal strength than at least one of other audio signals, the signal strengths corresponding to the amplitudes of the audio signals, where the line controller is further configured to control at least one of the transfer functions of the signal lines so that a signal power of the output signal is equal to a sum of the powers of the audio signals, and where the line controller comprises a compensation filter arranged in one of the signal lines and a compensation filter controller coupled to the compensation filter and to at least one of other signal line, the compensation filter being configured to provide a compensation transfer function for the one signal line that is controllable by the compensation filter controller, and the compensation filter controller being configured to control the compensation filter based on the at least one of other audio signals so that the signal power of the output signal is equal to the sum of the powers of the audio signals.

13. The system of claim 12, where at least one of the transfer functions of the signal lines comprises a delay time, and where the line controller is further configured to evaluate the signal strengths of the audio signals and to control the delay time so that the phase of the output signal corresponds to the phase of the audio signal whose signal strength is higher than a threshold strength.

14. The system of claim 13, where at least one of the signal lines comprises at least one controllable delay element, and where the delay time is controlled through the at least one controllable delay element.

15. The system of claim 14, where the line controller comprises an adaptive filter supplied with the audio signals that has a transfer function and where the line controller comprises a delay and sign calculator coupled to the adaptive filter, the adaptive filter being configured to filter one of the audio signals according to a reference signal representing the at least one of other audio signals, and the delay and sign calculator being configured to control the at least one controllable delay element based on the transfer function of the adaptive filter.

16. The system of claim 12, where at least one of the transfer functions of the signal lines comprises a delay time, and where the line controller is configured to evaluate the signal strengths of the audio signals and to control the delay time so that the phase of the output signal corresponds to the phase of the audio signal whose signal strength is higher than the signal strength of each of the at least one of other audio signals.

* * * * *